US008374057B2

(12) United States Patent
Journe

(10) Patent No.: US 8,374,057 B2
(45) Date of Patent: Feb. 12, 2013

(54) MINUTE-REPEATER TIMEPIECE

(75) Inventor: Francois-Paul Journe, Geneva (CH)

(73) Assignee: Montres Journe S.A., Geneva (CH)

( * ) Notice: Subject to any disclaimer, the term of this patent is extended or adjusted under 35 U.S.C. 154(b) by 215 days.

(21) Appl. No.: 12/936,322

(22) PCT Filed: Apr. 2, 2009

(86) PCT No.: PCT/CH2009/000111

§ 371 (c)(1),
(2), (4) Date: Oct. 4, 2010

(87) PCT Pub. No.: WO2009/121198

PCT Pub. Date: Oct. 8, 2009

(65) Prior Publication Data

US 2011/0032803 A1 Feb. 10, 2011

(30) Foreign Application Priority Data

Apr. 4, 2008 (EP) ..... 08405096

(51) Int. Cl.
*G04B 23/02* (2006.01)

(52) U.S. Cl. ..... 368/72

(58) Field of Classification Search ..... 368/72–75, 368/243, 244, 259, 260, 267–271
See application file for complete search history.

(56) References Cited

U.S. PATENT DOCUMENTS

| | | | | |
|---|---|---|---|---|
| 447,973 | A * | 3/1891 | Reber | 368/268 |
| 4,036,005 | A * | 7/1977 | Jauch | 368/269 |
| 7,330,403 | B2 * | 2/2008 | Goeller | 368/75 |
| 8,174,936 | B2 * | 5/2012 | Papi | 368/75 |

FOREIGN PATENT DOCUMENTS

| | | |
|---|---|---|
| EP | 1429214 A1 | 6/2004 |
| EP | 1760545 A1 | 3/2007 |

OTHER PUBLICATIONS

Reymondin et al., Theorie d'horlogerie, 1998, Editions de la Fet, Lausanne, Switzerland, pp. 219-223.
International Search Report (ISR) of PCT/CH2009/000111, mailing date Aug. 24, 2009.

* cited by examiner

*Primary Examiner* — Edwin A. Leon
(74) *Attorney, Agent, or Firm* — Westerman, Hattori, Daniels & Adrian, LLP

(57) ABSTRACT

The escapement racks for the hour (11), for the quarter-hour (10) and for the minutes (9) on the minute-repeater are mounted such that the same pivot about a common axis (14), with the escapement racks for the hour and the quarter-hour on one side, and the racks for the quarter-hour and for the minutes on the other side connected by a unidirectional drive connection having a ratchet (15, 17), a toothed pawl (10*a*, 9*a*) engaging with the ratchet, a banking pin (10*b*, 9*b*) and a cam (16*b*, 18*b*) to enable selective engagement of the ratchet with the pawl teeth. The end of the motor spring is kinetically secured to the two separate sets of activating pawl teeth (13*a*, 13*b*) for the first chime lift (21), with the first set of teeth (13*a*) for the hour chime, and the second set of teeth (13*b*) for chiming quarter-hours and minutes.

8 Claims, 4 Drawing Sheets

MINUTE-REPEATER TIMEPIECE

BACKGROUND ART

The present invention relates to a timepiece with minute repeater, comprising an hour rack, a positive-return link between this rack and one end of a driving spring, a manual tensioning lever fixed to the hour rack, an hour-striking cam to limit the degree of tensioning of the driving spring to the number of hours to be struck, a quarter rack, a driving link between the hour rack and the quarter rack, a quarter-striking cam to limit the movement of the quarter rack to the number of quarters to be struck, a minute rack, a driving link between the quarter rack and the minute rack, a minute-striking cam to limit the movement of the minute rack to the number of minutes to be struck, two striking hammers, each connected to a gong, sets of teeth and pallets for selectively activating each of the two striking hammers depending on the time indication to be struck.

Timepieces with minute repeaters of the type mentioned above have been known for a long time. One such mechanism is described in particular on the site www.horlogerie-suisse.com in the Complications section. In that mechanism the hour rack drives one end of the driving spring via a toothed bar meshing with a pinion fixed to the end of the driving spring. This pinion is fixed to an hour ratchet which engages with the hour striking pallet. The quarters are struck by two sets of teeth on the quarter piece and the minutes are struck by a set of ratchet teeth on the minute piece, which is driven by the quarter piece.

For this mechanism to work properly, the various racks must be free, and for this purpose they must be separated from each other by sufficient play to prevent them contacting each other. The sets of striking teeth associated with the various racks have to operate four striking pallets. Consequently, each hammer is activated alternately by two striking pallets. This superposition of members which must be separated by sufficient play to allow them to move freely relative to each other occupies a considerable height. It is for this reason that it becomes difficult to make a thin timepiece with that kind of minute-repeater mechanism, especially a wristwatch, where thickness is a particularly critical factor. In point of fact, a conventional repeater mechanism increases the total thickness of the movement very considerably.

SUMMARY OF THE INVENTION

The object of the present invention is to at least partly solve the above-mentioned problems.

To this end, the subject of this invention is a timepiece with a minute repeater, comprising an hour rack, a positive-return link between this rack and one end of a driving spring, a manual tensioning lever fixed to the hour rack, an hour-striking cam to limit the degree of tensioning of the driving spring to the number of hours to be struck, a quarter rack, a driving link between the hour rack and the quarter rack, a quarter-striking cam to limit the movement of the quarter rack to the number of quarters to be struck, a minute rack, a driving link between the quarter rack and the minute rack, a minute-striking cam to limit the movement of the minute rack to the number of minutes to be struck, two striking hammer, each connected to a gong, sets of teeth and pallets for selectively activating each of the two striking hammers depending on the time indication to be struck; in which timepiece the hour racks, quarter racks and minute racks pivot about a common pin, the hour racks and quarter racks on the one hand, and the quarter racks and minute racks on the other being connected by a unidirectional driving link comprising a click, a set of ratchet teeth for engaging with the click, a stop and a cam for selectively engaging the click, with the set of teeth, and in that said end of the drive spring is kinematically fixed to two separate sets of teeth for activating a first striking pallet, the first set of teeth for striking the hours and the second set of teeth for striking the quarters and the minutes and a set of ratchet teeth fixed to the quarter rack to engage with a pallet for activating the second hammer in alternation with the first hammer for striking the quarters.

In this minute repeater, each hammer is activated by a single pallet working with a single toothed member.

This arrangement makes it no longer necessary to have play between the different racks, and the racks can simply be superposed with no play between them, which saves a useful amount of thickness.

The transmission of the driving force for rewinding the racks after the time has been struck takes place from the driving spring to the hour-striking rack, which drives the quarter rack, which drives the minute rack.

Besides the saving in thickness, the minute repeater of the invention also simplifies the mechanism.

BRIEF DESCRIPTION OF THE DRAWINGS

The accompanying drawings illustrate, schematically and by way of example, one embodiment of the timepiece with minute repeater according to the invention.

DETAILED DESCRIPTION OF PARTICULAR EMBODIMENTS

Figure 1:
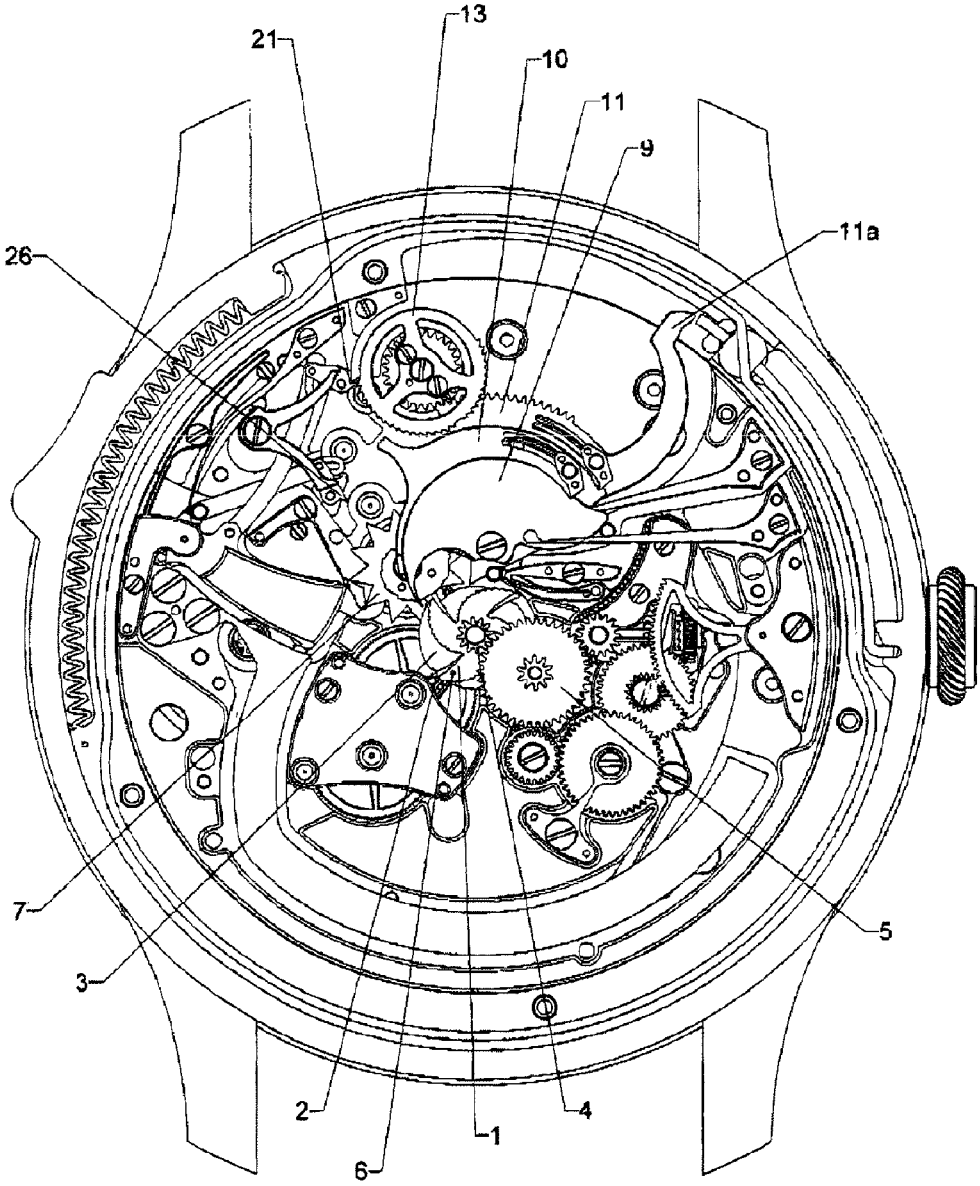
FIG. 1 is a plan view of the back of a wristwatch with a minute repeater.

In the minute repeater mechanism illustrated in FIGS. 1-4, at the center of the movement is a minute cam or snail 1 underneath which is the surprise piece 2 (visible in FIG. 1) and the quarter cam or snail 3. These cams 1-3 are driven at a rate of one revolution per hour with the cannon pinion 4 by the minute wheel 5 (FIG. 1) of the motion work.

With each revolution of the cams, a pin 6 comes into engagement with a star 7 with twelve arms on which is fixed a snail cam 8 called the hour cam, divided into twelve steps and therefore makes two revolutions in 24 hours.

Each cam 1,3 and 8 is linked to a rack. The minute cam 1 is linked to the minute rack 9, the quarter cam 3 is linked to the quarter rack 10, and the hour cam is linked to the hour rack 11.

This last comprises a winding lever 11*a* and a sector gear 11*b* meshing with a wheel 12 on whose pin is fixed one end of a striking spring (not shown), the other end of which is fixed to a stationary part. A striking wheel 13 is screwed to the wheel 12.

The three racks 9-11 pivot on a shared pin, on which they are held by a screw 14. The hour rack 11 is connected to the quarter rack 10 by a click 15 fixed to two pins 15*a*, 15*b*. The pin 15*a* is engaged with a spring 11*c* cut from the hour rack 11, which tends to turn the click 15 in the clockwise direction and the pin 15*b* is engaged with a cam 16*a*, 16*b* with two radii, visible in FIG. 4. This cam is fixed to the frame of the timepiece. The click 15 travels along a surface in the shape of an arc of a circle on the quarter rack 10 concentric with the pivot pin which coincides with the pin of the fixing screw 14 of this rack 10. This surface in the shape of an arc of a circle has a set of teeth 10*a* and a stop 10*b* at one end. The cam 16*a*, 16*b* is designed to make the click 15 engage with this set of teeth 10*a*, as will be described later.

A second click 17 identical to the previous click, with two pins 17*a*, 17*b* is engaged respectively with a spring 10*c* cut from the quarter rack 10 and with a cam 18*a*, 18*b* with two radii fixed to the frame of the watch. The click 17 travels along a surface in the shape of an arc of a circle on the minute rack 9 concentric with the pivot pin which coincides with the pin of the fixing screw 14 of this rack 9. This surface in the shape of an arc of a circle has a set of teeth 9*a* and a stop 9*b* at one end.

The quarter rack 10 is pushed counterclockwise by a spring 19 and the minute rack 9 is pushed in the same direction by a spring 20. In the clockwise direction, the minute rack 9 is retained by a stop 34 fixed to the frame.

The minute rack 9 has a nose 9*d* for taking the strike from the minute snail 1, the quarter rack 10 has a nose 10*d* for taking the strike from the quarter snail 3, and the minute rack 11 has a nose 11*d* for taking the strike from the hour cam 8.

The striking wheel 13 comprises two sets of teeth 13*a*, 13*b*, the first for striking the hours and the second for striking the first note of the quarters and minutes. A space separates these two sets of teeth 13*a*, 13*b* to produce a pause when the repeater strikes 11 hours plus one, two or three quarters, allowing the hours to be distinguished from the quarters. The sets of teeth 13*a*, 13*b*, which are ratchet teeth, act on a striking pallet 21 pivoted on a fixed pin 22 comprising a peg 21*a* engaged in a groove 23*a* in the shape of an arc of a circle centered on the pivot pin 22, formed in an arm 23 hinged to a hammer 24 which is pressed by a return spring 25. When the striking wheel 13 rotates clockwise, the ratchet teeth 13*a*, 13*b* cause the click to pivot about its pin 22 and the peg 21*a* travels along the groove 22 with no effect on the hammer. When the striking wheel rotates counterclockwise, each ratchet tooth 13*a*, 13*b* raises the arm 23, which then falls back under the pressure of the return spring 25 which makes the hammer 24 strike a gong 35.

The quarter rack 10 has an arm 10*e* that ends in a set of ratchet teeth 10*f* designed to engage with a second striking pallet 26 identical to the pallet 21 and mounted so as to pivot on a stationary pin 27 and engage with an arm 28 hinged to a second hammer 29 designed to strike a second gong underneath the first gong 35 (not visible because the latter covers it). This second hammer 29 is acted on by a return spring 32 and is designed to strike only the second note of the quarters in alternation with the first note struck by the hammer 24.

The upper surfaces of the striking pallets 21 and 26 each have two planar surfaces on two respective levels, forming a bearing surface between them against which the end of an arm 30*a* rests in the case of the pallet 21, or 30*b* in the case of the pallet 26. These two arms 30*a*, 30*b* are fixed together and pivot about a stationary pin 31. A return spring 33 serves to press the ends of both arms 30*a*, 30*b* simultaneously against the bearing surfaces of the two pallets 21, 26, respectively, so as to keep the ends of these pallets in the paths of the sets of teeth 13*a*, 13*b*, and 10*f*, respectively.

Figure 2:
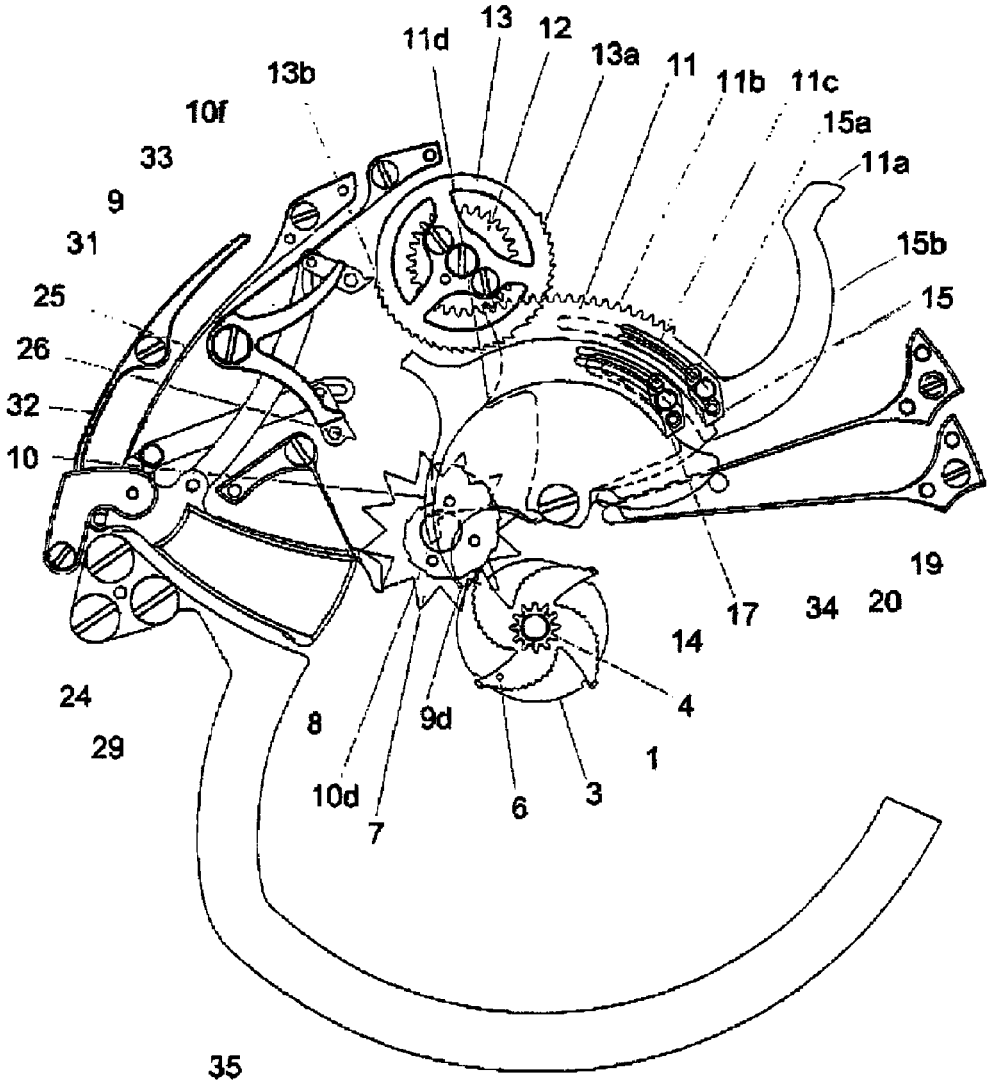
FIGS. 2-4 are partial plan views from FIG. 1, showing only the minute-repeater mechanism, in three positions: at rest; winding and striking at one o'clock; and winding and striking at 11 o'clock, three quarters and 14 minutes.

When a person wishes to operate the minute repeater, beginning in the position shown in FIG. 2, for example, which corresponds to the position in which all the racks 9-11 are returned to their stop positions, and the timepiece indicates a time of 11:59 (FIG. 4), the lever 11*a* is moved counterclockwise to wind the driving spring fixed to the wheel 12 and to bring the nose 11*d* of the rack into contact with the hour cam 8. As soon as the lever 11*a* is moved, it releases the racks 10 and 9 which are moved in the same direction as the hour rack 11 by their respective springs 19 and 20, until their respective noses 10*d* and 9*d* abut against the quarter snail or cam 3 and minute snail or cam 1, respectively.

Figure 4:
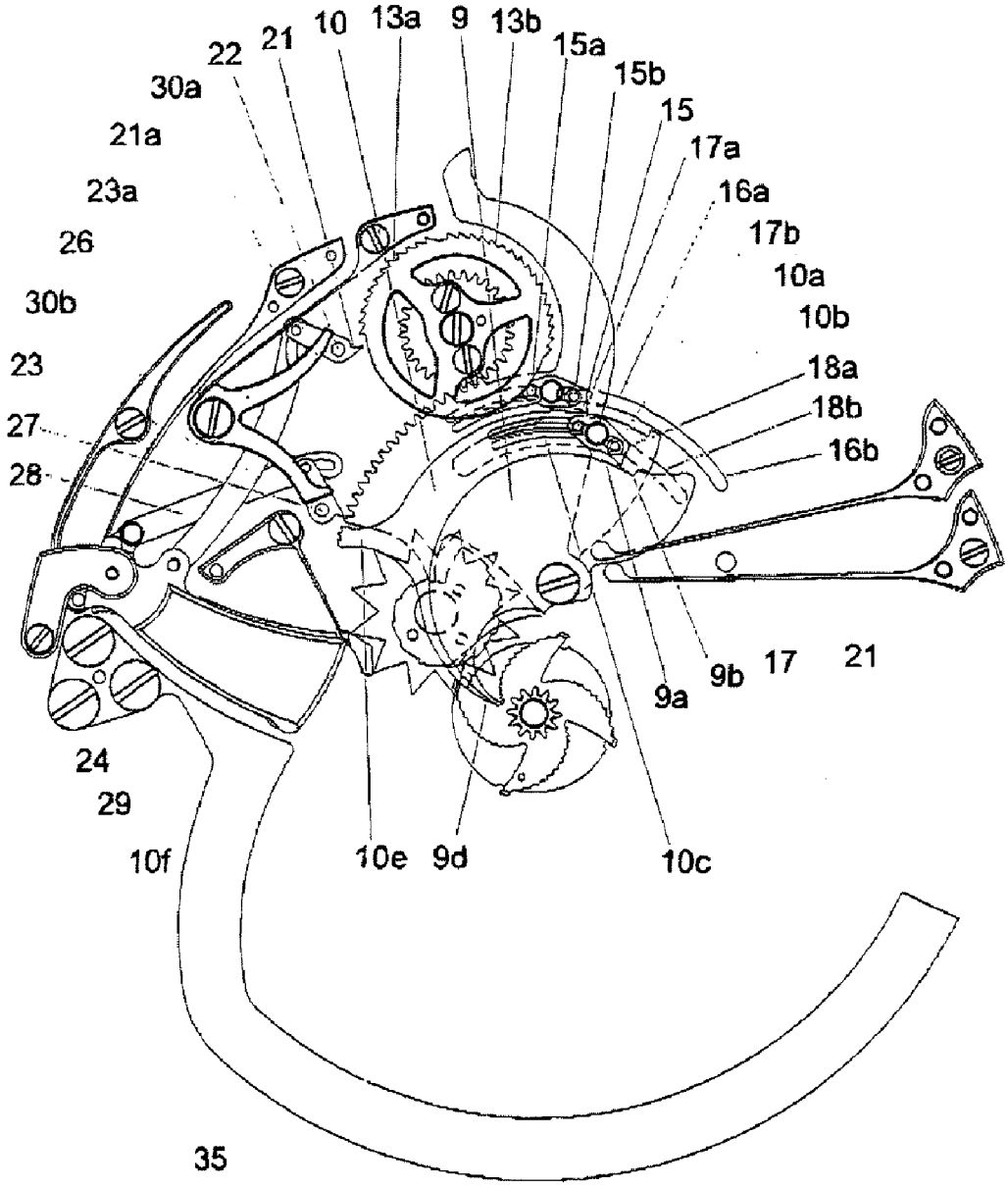

As soon as the pressure on the level 11*a* is removed, the driving spring drives the wheel 12 counterclockwise so that the hour rack is driven clockwise and causes the first gong 35 to be struck by the hammer 24 every time the pallet 21 moves over a tooth 13*a*, in the case of FIG. 4, with each passage, of the 11 teeth of the set of teeth 13*a*.

This series of strikes is followed by a short pause corresponding to the pallet 21 moving from the teeth 13*a* to the teeth 13*b*. The click 15 of the hour rack which has reached the stop 10*b* drives the quarter rack 10. The first gong 35 is struck by the hammer 24 in alternation with the second gong being struck by the hammer 29 controlled by the arm 28, the lever 26 and the set of teeth 10*f* on the arm 10*e* of the quarter rack 10.

When the latter has finished striking the quarters, in the example shown in FIG. 4, the click 17 reaches the stop 9*b* of the minute rack 9 and drives the latter as far as the stop 34, causing the 14 minute blows to be struck on the way.

Figure 3:
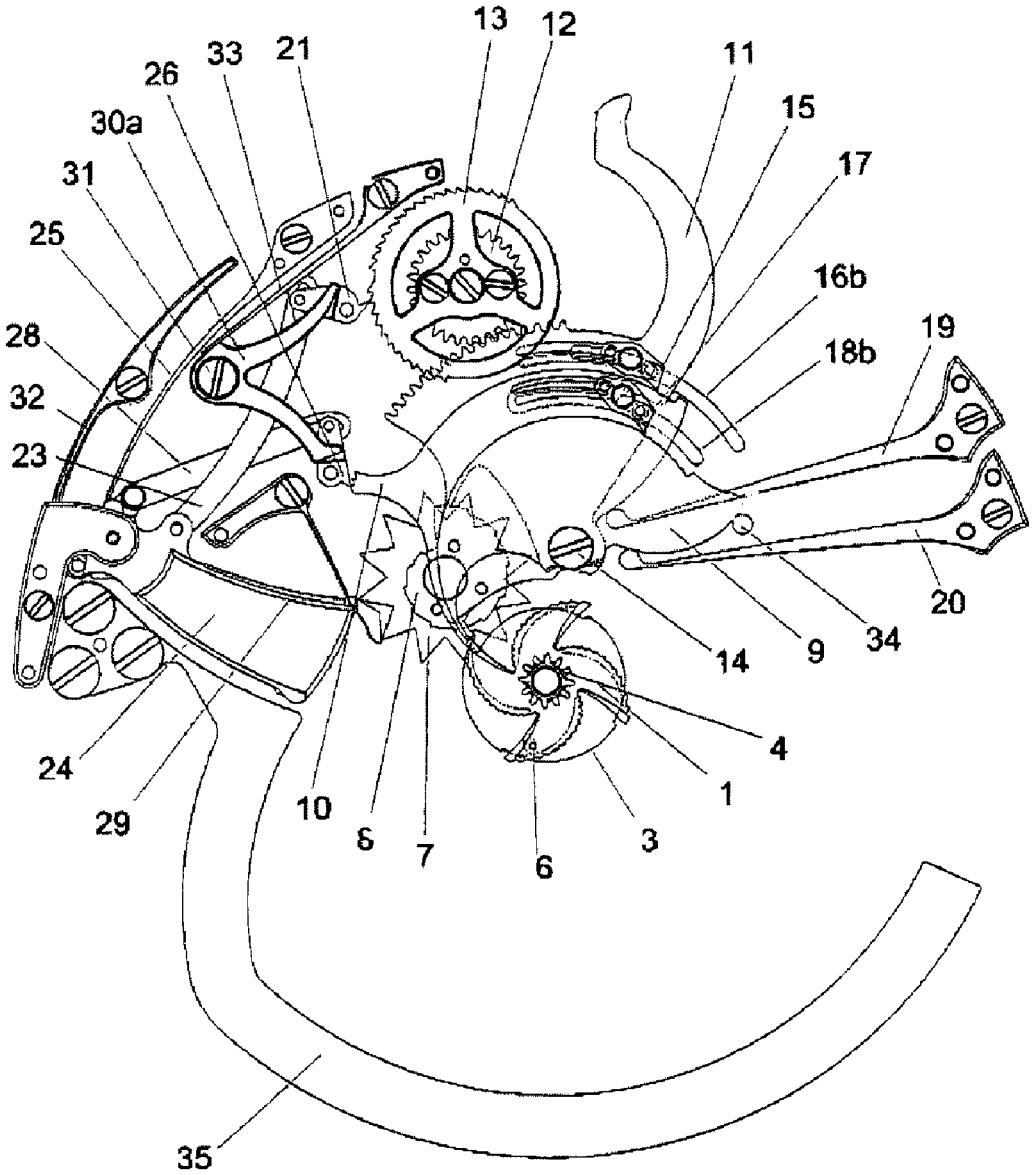

The number of strikes sounded obviously depends on the information received by each rack. FIG. 3 shows the case in which the repeater strikes exactly one o'clock. In this case, when the lever is set, the nose 11*d* meets the highest step on the hour snail cam 8, stopping the striking wheel 13 when the pallet 21 is opposite the last tooth of the set of teeth 13*a*. The nose 9*d* of the minute rack 9 and the nose 10*d* of the quarter rack 10 meet the larger-diameter parts of the cams 1, 3, respectively.

When the lever 11*a* is released, the driving spring drives the wheel 13 to position the pallet 21 between the sets of teeth 13*a* and 13*b*. The clicks 15 and 17 are engaged by the respective cams 16*b*, 18*b* with the first tooth of each set of ratchet teeth 10*a*, 9*a* when the minute rack 9 is pressed against the stop 34, preventing any movement of the racks and therefore preventing any striking after the single strike of one o'clock has been sounded.

The invention claimed is:

1. A timepiece with minute repeater, comprising an hour rack , a positive-return link between this rack and one end of a driving spring, a manual tensioning lever fixed to the hour rack, an hour-striking cam to limit the degree of tensioning of the driving spring to the number of hours to be struck, a quarter rack, a driving link between the hour rack and the quarter rack, a quarter-striking cam to limit the movement of the quarter rack to the number of quarters to be struck, a minute rack, a driving link between the quarter rack and the minute rack, a minute-striking cam to limit the movement of the minute rack to the number of minutes to be struck, two striking hammers, each connected to a gong, sets of teeth and pallets for selectively activating each of the two striking hammers depending on the time indication to be struck;

in which timepiece the hour racks, quarter racks and minute racks pivot about a common pin, the hour racks and quarter racks on the one hand, and the quarter racks and minute racks on the other being connected by a unidirectional driving link comprising a click, a set of ratchet teeth for engaging with the click, a stop and a cam for selectively engaging the click, with the set of teeth, and in that said end of the drive spring is kinematically fixed to two separate sets of teeth for activating a first striking pallet, the first set of teeth for striking the hours and the second set of teeth for striking the quarters and the minutes and a set of ratchet teeth fixed to the quarter rack to engage with a pallet for activating the second hammer in alternation with the first hammer for striking the quarters.

2. The timepiece as claimed in claim 1, in which the hour rack, the quarter rack, and the minute rack are mounted with no play between them.

3. The timepiece as claimed in claim 1, in which the cam for selectively engaging the click with the set of teeth is a cam fixed to a stationary part of the mechanism and comprises two successive arcs of circles which are concentric with the pivot pin of the racks and which have two different radii, a cam feeler fixed to the click and off-center from its pivot pin for engaging the click with the set of ratchet teeth in a predetermined angular position of the rack that depends on the time to be struck.

4. The timepiece as claimed in claim 1, in which the minute repeater is fitted to a wristwatch movement.

5. The timepiece as claimed in claim 2, in which the cam for selectively engaging the click with the set of teeth is a cam fixed to a stationary part of the mechanism and comprises two successive arcs of circles which are concentric with the pivot pin of the racks and which have two different radii, a cam feeler fixed to the click and off-center from its pivot pin for engaging the click with the set of ratchet teeth in a predetermined angular position of the rack that depends on the time to be struck.

6. The timepiece as claimed in claim 2, in which the minute repeater is fitted to a wristwatch movement.

7. The timepiece as claimed in claim 3, in which the minute repeater is fitted to a wristwatch movement.

8. The timepiece as claimed in claim 5, in which the minute repeater is fitted to a wristwatch movement.

* * * * *